US005191994A

United States Patent [19]

Stauble

[11] Patent Number: 5,191,994

[45] Date of Patent: Mar. 9, 1993

[54] WATER BOTTLE CRATE

[76] Inventor: Alfred G. Stauble, P.O. Box 17, 2 Main St., Hollis, N.H. 03049

[21] Appl. No.: 896,228

[22] Filed: Jun. 10, 1992

[51] Int. Cl.[5] ..... B65D 11/16

[52] U.S. Cl. ..... 220/771; 220/675; 220/676

[58] Field of Search ..... 220/675, 676, 771; 206/446

[56] References Cited

U.S. PATENT DOCUMENTS

| | | | |
|---|---|---|---|
| D. 255,656 | 7/1980 | Stauble | D9/177 |
| 4,143,784 | 3/1979 | Frahm et al. | 220/676 X |
| 4,520,941 | 6/1985 | Hagen et al. | 220/675 |
| 4,520,941 | 6/1985 | Hagan et al. | 220/675 |
| 4,589,560 | 5/1986 | Harris, Jr. | 215/1 C |
| 4,819,822 | 4/1989 | Box | 220/676 X |
| 4,901,876 | 2/1990 | Box | 220/675 X |

FOREIGN PATENT DOCUMENTS 1164372 3/1984 Canada .

OTHER PUBLICATIONS

Photograph of wood bottle carrier.

*Primary Examiner*—Steven M. Pollard
*Attorney, Agent, or Firm*—Fish & Richardson

[57] ABSTRACT

A crate for the storage and transport of a water bottle is provided, which includes two pairs of opposed side walls joined at their adjoining longitudinal edges to define a square box, a back wall, joined to rear widthwise edges of the side walls, closing one end of the box, at least one of said side walls having a handle opening in a location which is approximately over the center of gravity of the box when the box contains a full water bottle.

3 Claims, 6 Drawing Sheets

WATER BOTTLE CRATE

BACKGROUND OF THE INVENTION

The invention relates to a crate for storing and transporting a water bottle.

Drinking water for use in "water bubbler" dispensers is often supplied in large capacity, e.g., 5 gallon, water bottles. Water bottles are sometimes transported and stored in molded plastic crates, for example, as described in U.S. Pat. Nos. 4,520,941, 4,589,560 and U.S. Pat. Des. No. 255,656. These crates tend to be difficult to lift and unwieldy, due to the weight of the water, which is more than 40 pounds for a standard 5 gallon bottle.

SUMMARY OF THE INVENTION

The invention provides molded plastic crates for the storage and transport of a water bottle, which are easy to lift and maneuver. In one aspect, the crate includes two pairs of opposed side walls joined at their adjoining longitudinal edges to define a square box, a back wall, joined to rear widthwise edges of the side walls, closing one end of the box, at least one of said side walls having a handle opening in a location which is approximately over the center of gravity of the box when the box contains a full water bottle.

In preferred embodiments, each side wall has raised and recessed areas dimensioned and located to engage respective raised and recessed areas on a side wall of a second crate; said handle opening is dimensioned so that the fingers of a human hand can be inserted through said opening; the side walls and back wall are integrally joined; one of said side walls includes a flange disposed along the inside of a front widthwise edge of said side wall for retaining a water bottle within the crate; and said crate comprises one handle opening disposed in the side wall opposite said flange.

BRIEF DESCRIPTION OF THE DRAWINGS

FIG. 3 is a bottom view of the crate of FIG. 1.

DESCRIPTION OF THE PREFERRED EMBODIMENT

Figure 1:
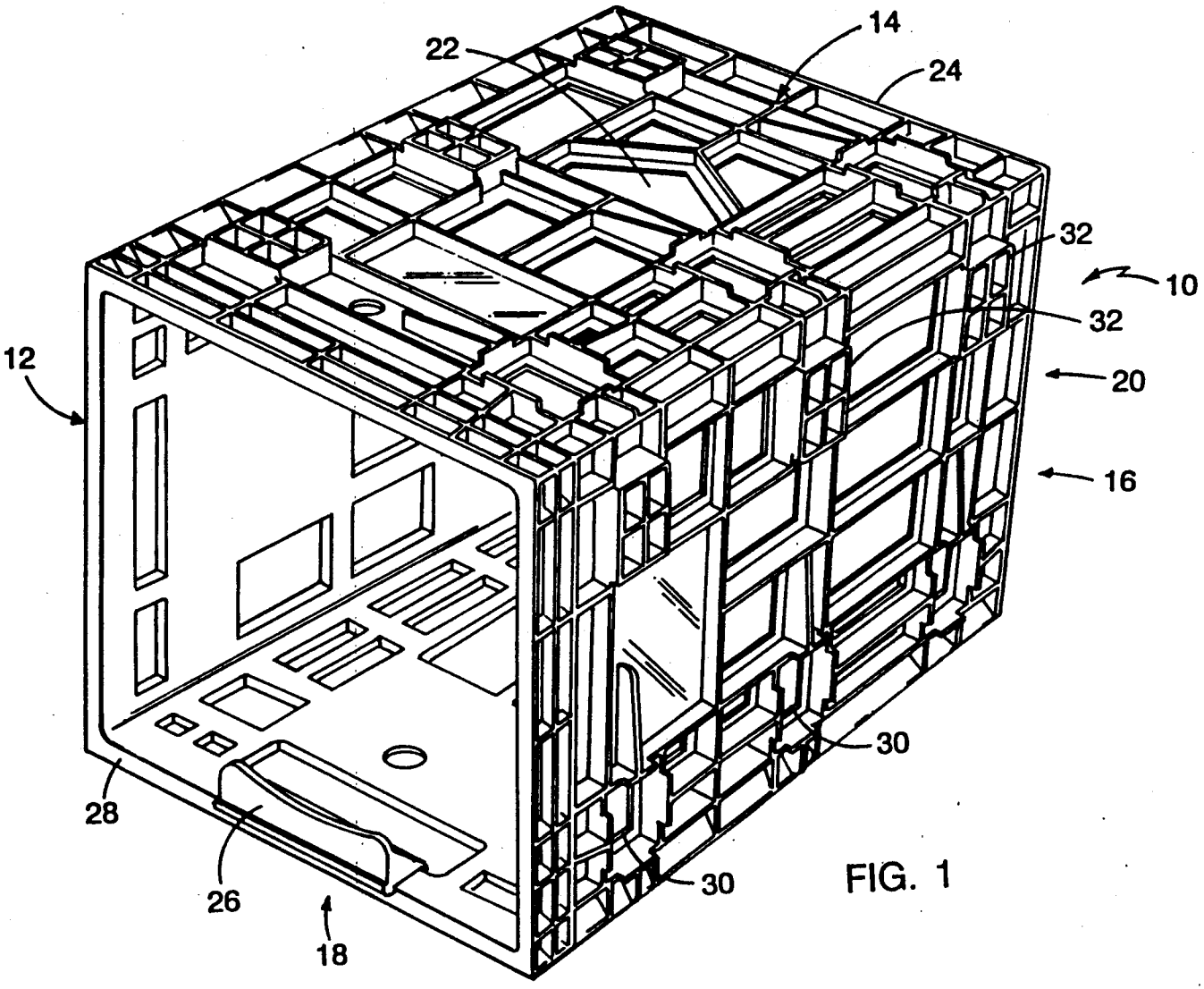
FIG. 1 is a perspective view of a crate according to one embodiment of the invention.
Figure 1A:
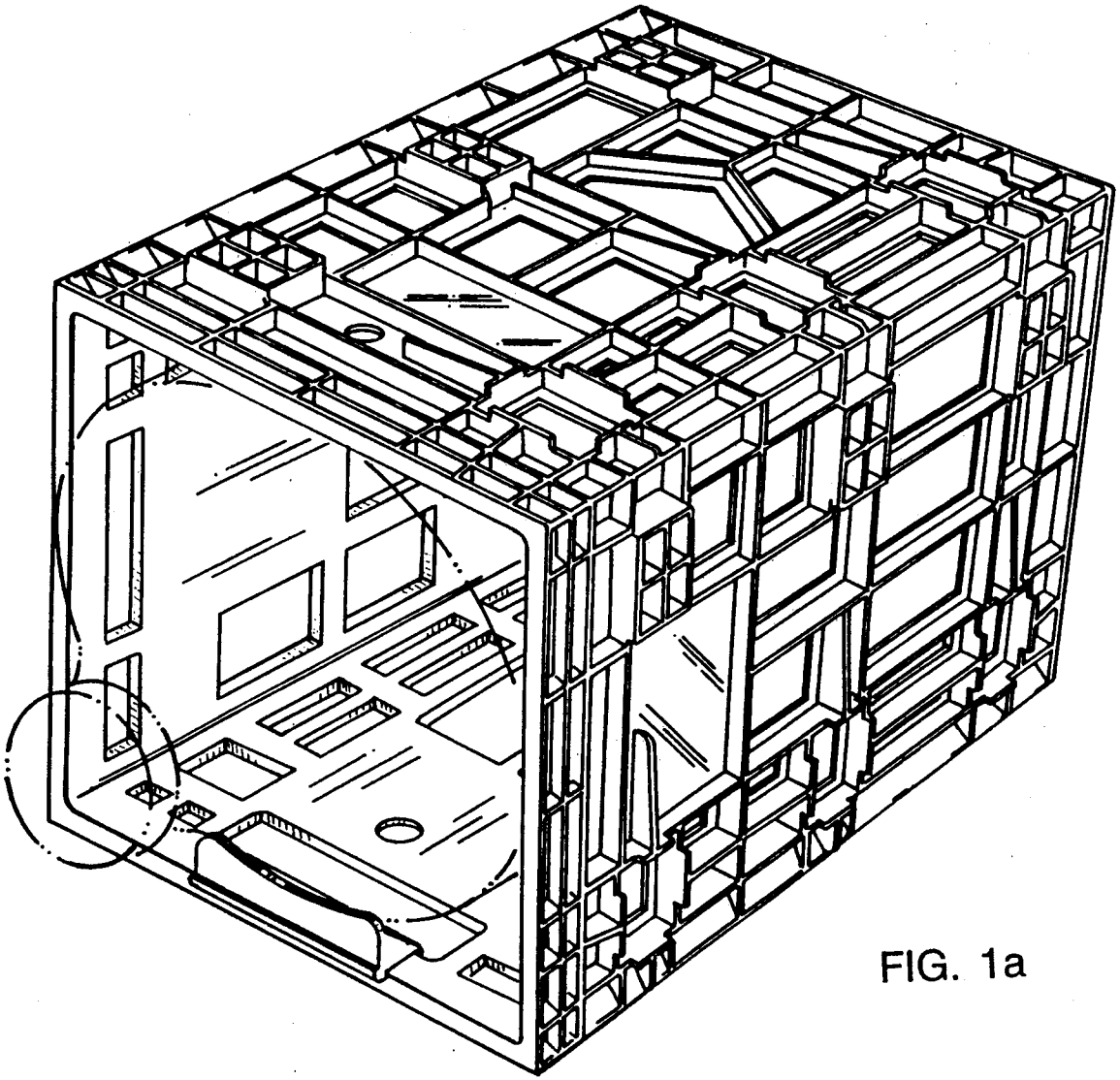
FIG. 1*a* a perspective view of a crate according to one embodiment of the invention, in broken lines, showing a water bottle disposed within the crate.
Figure 2:
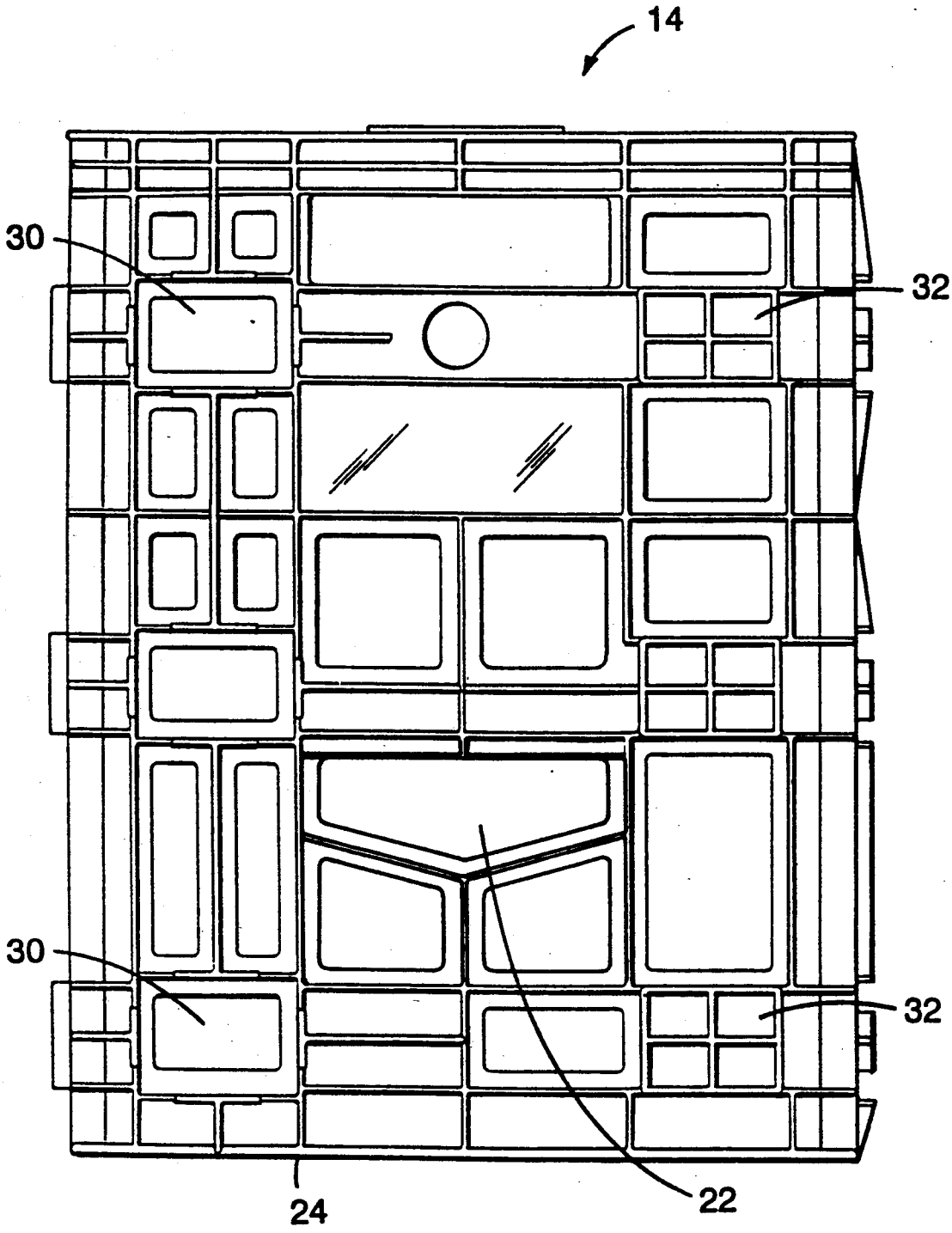
FIGS. 2 and 3 are top and bottom views, respectively, of the crate of FIG. 1.
Figure 3:
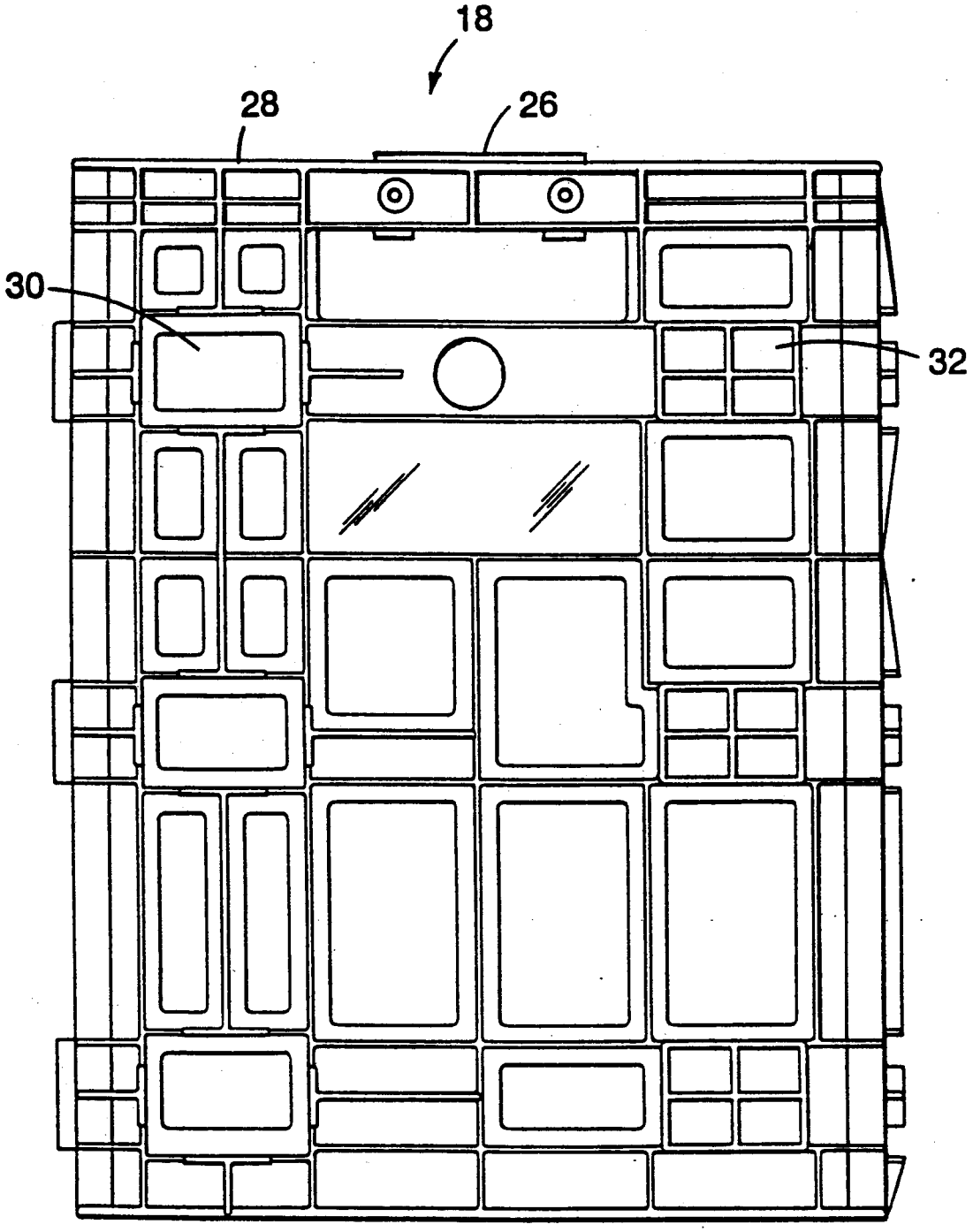
Figure 4:
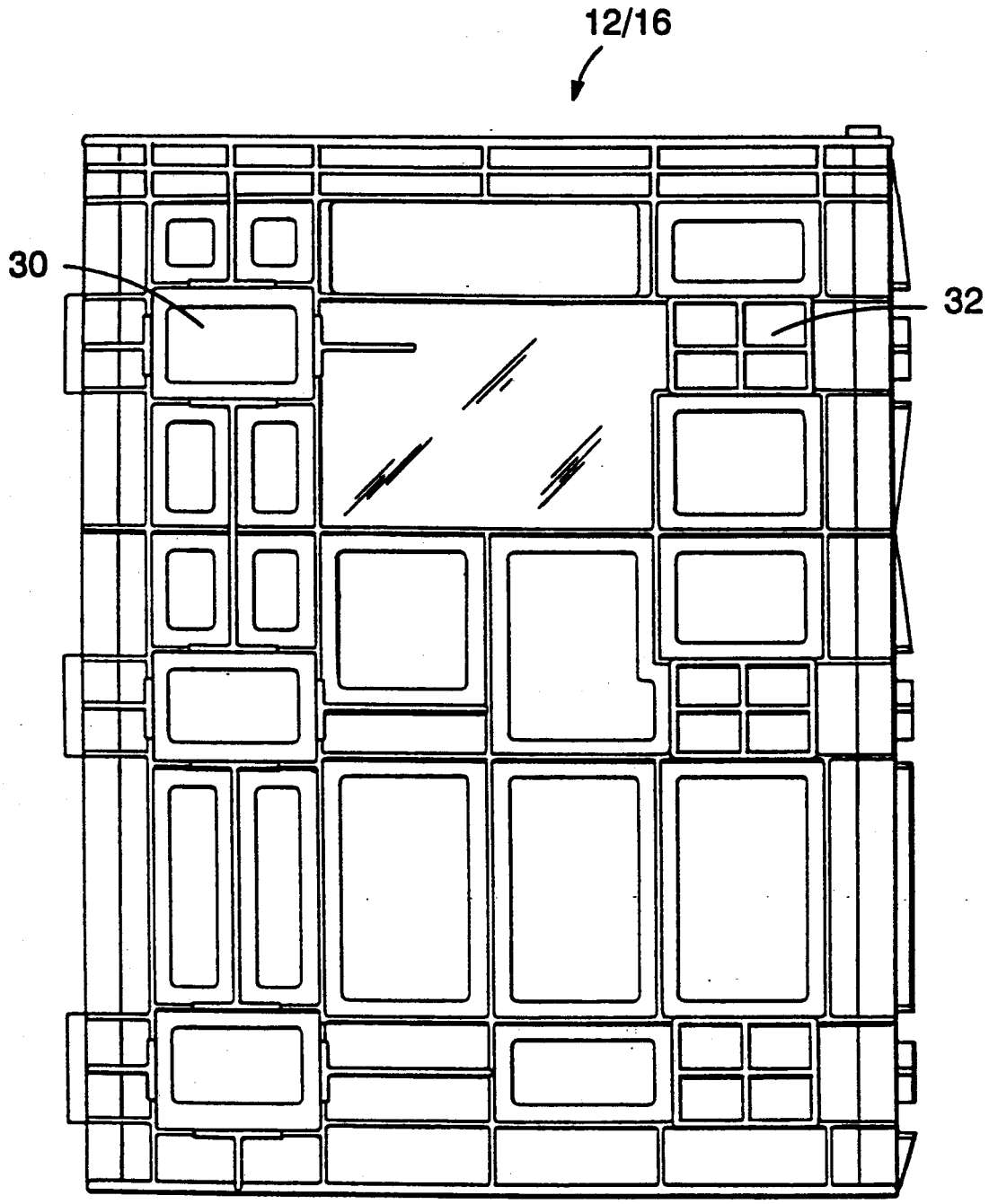
FIG. 4 is a side view of the crate of FIG. 1.
Figure 5:
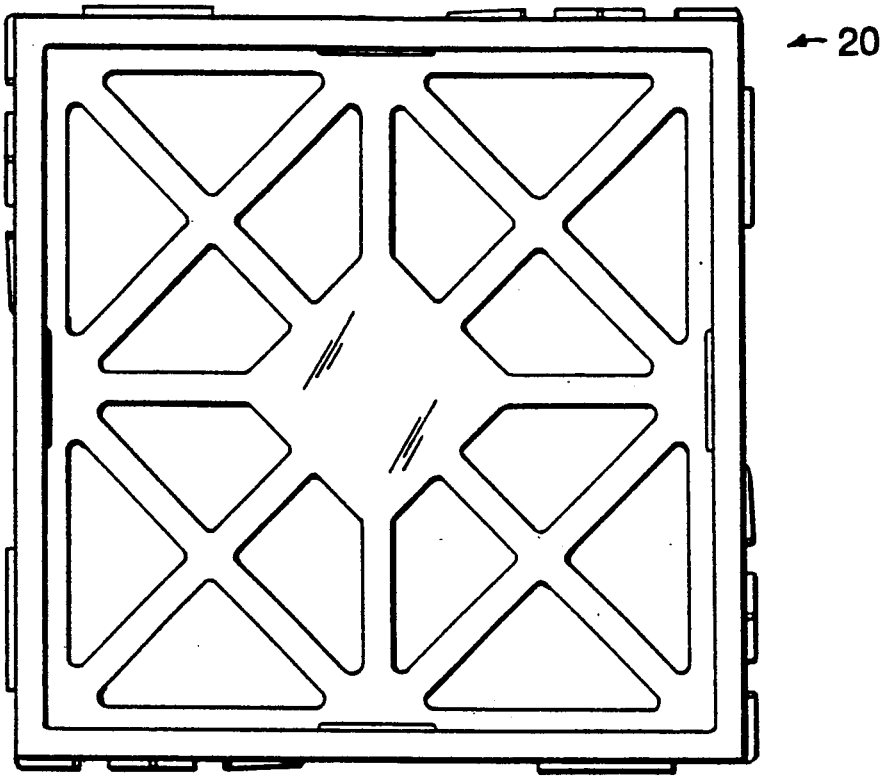
FIGS. 5 and 6 are back views of the crate of FIG. 1, taken from the inside and outside, respectively.
Figure 6:
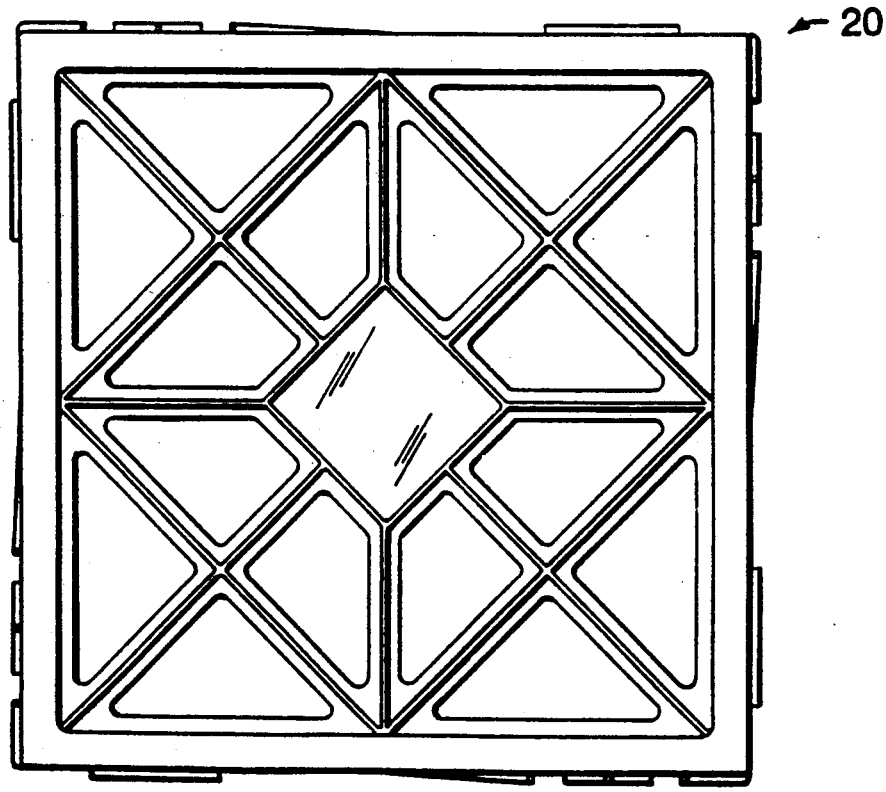

Referring to FIGS. 1–6, a water bottle crate 10 is shown, which includes side walls 12, 14, 16 and 18, and back wall 20. Side wall 14 includes handle opening 22, best shown in FIGS. 1 and 2, which is sized and shaped to accommodate the four fingers of a user's hand. Handle opening 22 is disposed directly over the center of gravity of the crate having a full water bottle, therein allowing the user to easily grasp and balance the crate containing the bottle. For example, for a standard sized water bottle crate, where each side wall measures approximately 12 inches by 15 inches, the center of the handle opening is approximately 5.5 inches from the rear edge 24 of side wall 14.

Crate 10 also includes flange 26, disposed along the front edge 28 of side wall 18. Flange 26 is shaped and positioned to retain a water bottle within the crate, as shown in FIG. 1.

To allow a plurality of crates to be stacked in a safe, stable configuration, each side wall includes recesses 30 and raised areas 32. Recesses 30 and raised areas 32 are positioned so that respective recesses and raised areas on adjacent sides of first and second crates engage to interlock the crates.

Other embodiments are within the claims.

What is claimed is:

1. A molded plastic crate for the storage and transport of a water bottle comprising two pairs of opposed side walls joined at their adjoining longitudinal edges to define a square box, a back wall, joined to rear widthwise edges of said side walls, closing one end of the box, at least one of said side walls having a handle opening, dimensioned so that the fingers of a human hand can be inserted through said opening, in a location which is approximately over the center of gravity of the box when the box contains a full water bottle.

2. The crate of claim 1 wherein the side walls and back wall are integrally joined.

3. The crate of claim 1 wherein said crate comprises one handle opening in a first side wall, and the side wall opposite said first side wall includes a flange disposed along the inside of a front widthwise edge of said side wall for retaining a water bottle within the crate.

* * * * *